US007014569B1

(12) United States Patent
Figgers

(10) Patent No.: US 7,014,569 B1
(45) Date of Patent: Mar. 21, 2006

(54) GOLF CLUB WITH REPLACEABLE HEADS

(76) Inventor: Herman Figgers, P.O. Box 82178, Mobile, AL (US) 36609

( * ) Notice: Subject to any disclaimer, the term of this patent is extended or adjusted under 35 U.S.C. 154(b) by 0 days.

(21) Appl. No.: 10/292,258

(22) Filed: Nov. 8, 2002

Related U.S. Application Data

(60) Provisional application No. 60/333,297, filed on Nov. 19, 2001.

(51) Int. Cl.
*A63B 53/02* (2006.01)

(52) U.S. Cl. ..... 473/288; 473/296; 473/299; 473/307

(58) Field of Classification Search ..... 473/307, 473/288, 296, 298, 299, 248, 245, 246; 463/294
See application file for complete search history.

(56) References Cited

U.S. PATENT DOCUMENTS 4,340,227 A * 7/1982 Dopkowski ..... 473/288
4,852,782 A * 8/1989 Wu et al. ..... 224/661
5,496,029 A * 3/1996 Heath et al. ..... 473/296
5,588,921 A * 12/1996 Parsick ..... 473/299
5,597,362 A * 1/1997 Lee et al. ..... 473/244
5,913,731 A * 6/1999 Westerman ..... 473/251
6,475,100 B1 * 11/2002 Helmstetter et al. ..... 473/309

FOREIGN PATENT DOCUMENTS

JP 11-178954 * 7/1999

* cited by examiner

*Primary Examiner*—Stephen Blau

(57) ABSTRACT

A set of at least two clubs is disclosed where each of the two clubs have a different length, one corresponding to a wood type club and the other to an iron length. A plurality of interchangeable heads are provided which may be fixed at a predetermined angle to the club to represent a more complete set of golf clubs. The use of at least two different clubs may be replaced in alternative embodiments with a single club which is extendable, which has a gripping end, an extending end, and an attachment end for receiving the club heads. One way the arm extends is by having set incremental extensions which are locked in place by way of a locking pin into a groove type locking mechanism. A second way that the arm is extendable is by having a friction lock which may be engaged or disengaged by pushing on a button which either engages or disengages a lever foot pushing against the extending portion of the arm. Another way of obtaining the extension is to supply each of the club heads with a club head extension which extension is itself of different length than another club head extension.

13 Claims, 17 Drawing Sheets

GOLF CLUB WITH REPLACEABLE HEADS

PRIORITY STATEMENT

This patent application claims priority to U.S. Provisional Patent Application 60/333,297 filed Nov. 19, 2001.

BACKGROUND OF INVENTION

1. Field of the Invention

The invention relates to golf clubs. More particularly the invention related to a set of golf heads attachable to at least one shaft of variable lengths.

2. Prior Art

GENERAL DISCUSSION OF THE INVENTION

The invention is best understood is a single club which is extendable, which has a gripping end, an extending end, which is extendable in at least one of many ways. One way the arm extends is by having set incremental extensions which are locked in place by way of a button type locking mechanism. A second way that the arm is extendable is by having a friction lock which may be engaged or disengaged by pushing on a button which either engages or disengages a lever pushing against the arm.

Another way that the arm is extendable is by screwing or unscrewing an extension from the gripping portion of the arm.

Regardless of which method is used, there is an indicating means which shows, utilizing color or number coding the appropriate extension for a specific club head which head has a corresponding number or color coded or some other form of coding.

In this way, quick reference can be made to the club head and the extension of the club in order to determine that the correct club is in place and that the arm is properly extended.

In some of the embodiments there is additionally a flexing portion of the club which is one or more flexing ends of the club, which flexing ends allow the club to flex and bend in a fashion mimicking that of clubs that do not have extending means. In this way the clubs may be made of multiple materials along their length in order to allow them to function optimally while being extendable. Along the lengths of the club there are tapered and not tapered portions from the top to the club head.

Another mechanism of providing a changeable length would be to have each of the club heads have a different length ankle portion. In this way the club itself would not have to extend, but there would be different length ankles on each of the club heads.

In one embodiment there are two separate clubs each having a different length and no extendability is used, but instead a plurality of golf heads for the first club, which is the length of a wood in the set, and the second club which is an iron length. The extendable club may be a part of one or both of the two clubs in this set as described herein one may be extendable, the other one could be of a fixed length.

There is also a special head for using as a putter in this embodiment. In this way a putter may be used both as a short putter or a long putter according to the use desired by the player and a heavier or lighter putting head may be utilized in order to maximize the club head weight for play on different thicknesses of grass or in different moisture conditions.

In addition, there is an alignment means and a locking means which serve to allow for proper alignment of the club heads onto the attachment end of the club shaft. Except by releasing a locking means by action specifically designed to remove the club head initiated by the user that the club head can not be separated so as to prevent the club heads from coming loose when in use.

In the preferred embodiment the locking means is in the form of a spring loaded lock mechanism which is colored green when the club head is locked in place so that the user will know visually that the club head is properly locked in place before attempting to use the club or swing the club in order to prevent any possibility that the head would come separated from the club during play.

Also shown, is a shoulder and stand mechanism for carrying the club and the belt over the users shoulder when moving from one location to the next.

It is therefore another object of the invention to provide a belt means which may be self supporting so that the user may clip or insert into pocket all of the club heads except for the one in use at a particular time and either wear the belt when traveling or set the belt down on its self supporting tri-pod when slinging a club.

It is therefore one object of the invention to provide a lighter and more transportable set of golf clubs, and a set of golf clubs which can be used by someone who would wish to walk a course and not drive a course without adding a great deal of additional weight.

It is another object of the invention to provide a club set of the type mentioned which is ergonomically designed to be carried by the user and also designed that in order to be supported when set down.

It is also one object of the invention to provide one club with the gripping end, an extending end, a vending end, an attaching end, a locking means, a marking means for the extension, a locking means for the extension and a locking means for the attachment of a plurality of golf heads corresponding to different golf heads which the user might desire in a particular setting.

It is also an object of the invention to provide such a mechanism in a golf club set which also includes socks in order to prevent contamination by dirt, sand or moisture.

These and other objects and advantages of the invention will become better understood hereinafter from a consideration of the specification with reference to the accompanying drawings forming part thereof, and in which like numeral correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 1:
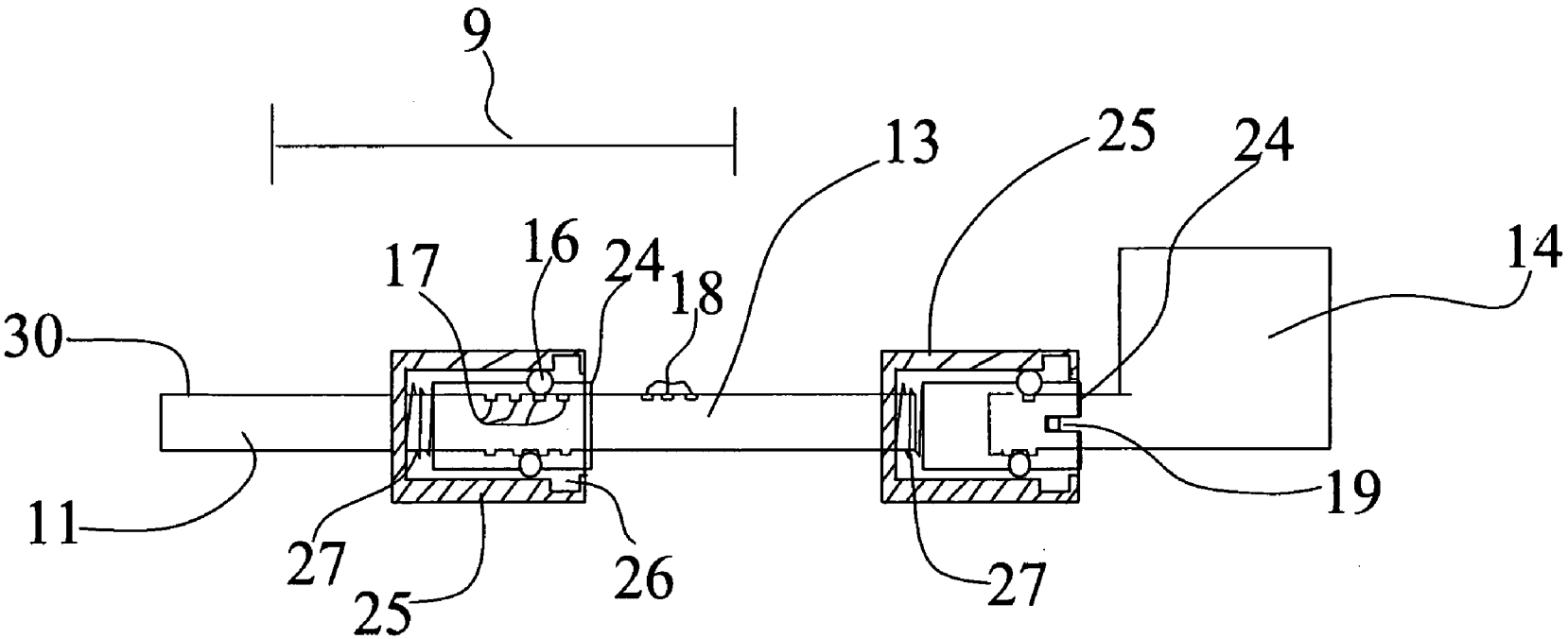
FIG. 1 is the preferred embodiment of the invention showing a ball bearing operated release for holding the club length and a club head.
Figure 5:
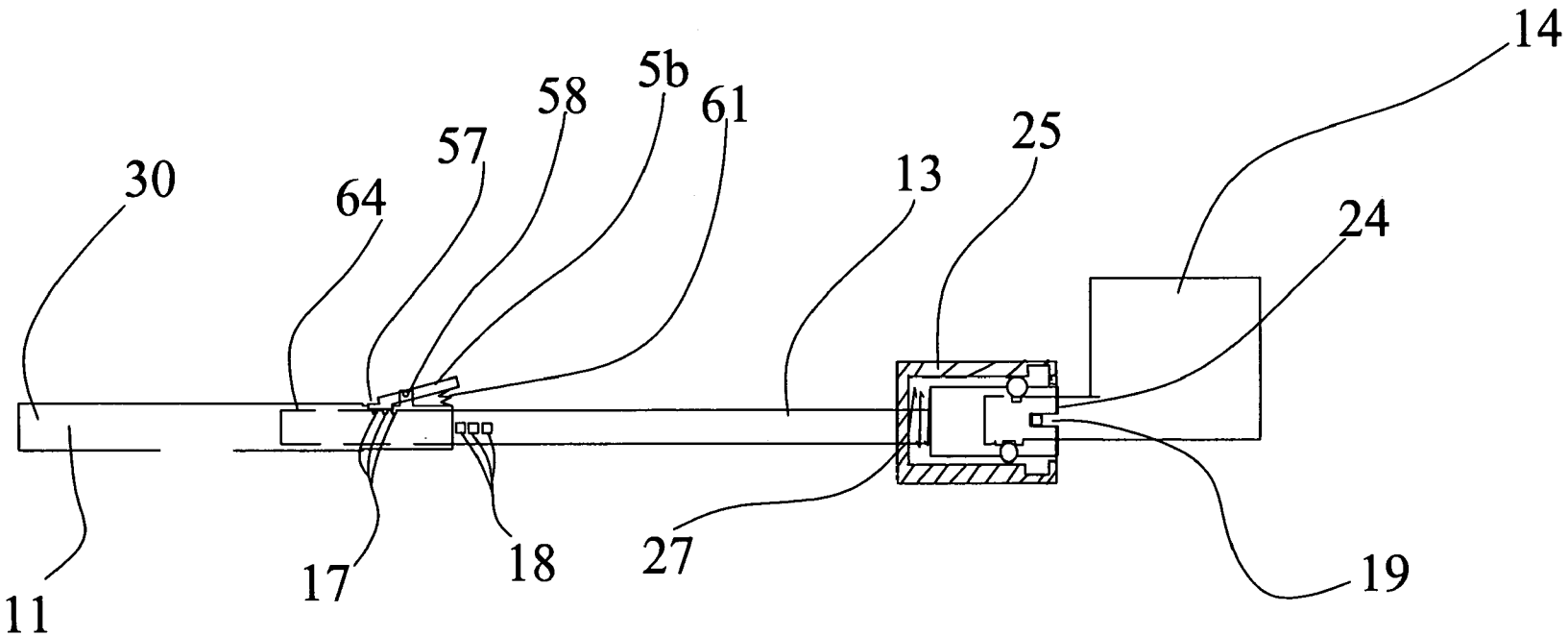
FIG. 5 shows an alternate adjusting mechanism for controlling the length of the club.

As shown in FIGS. 1 and 5, there is a gripping end 30 which has a first taper 11 which is a common design found in clubs.

In some embodiments, described below, a single club length for the gripping end 30 is possible. In this embodiment, an adjustment is possible in the club length at a non-tapering section 9, utilizing spring released bearings 16 within a bearing support cylinder 25 which bearings 16 can fix the location of the gripping end 30 on the second tapering end 13 by fitting fixedly into first holes 17 defined by the non-tapering portion 48 of the second tapering end 13. It would be possible to replace these holes 17 with threads (also a form of holes) and to replace the bearings 16 with threads within the cylinder 25 which cooperated with the threads to allow for adjustment or to combine these two methods. In this case the spring has an end attached to the cylinder 25 and is fixed on the other end to the gripping end so that the cylinder 25 can move against the spring 27 to allow the bearings 16 to be locked in place or released into release holes 26 defined by the cylinder 25.

Figure 8:
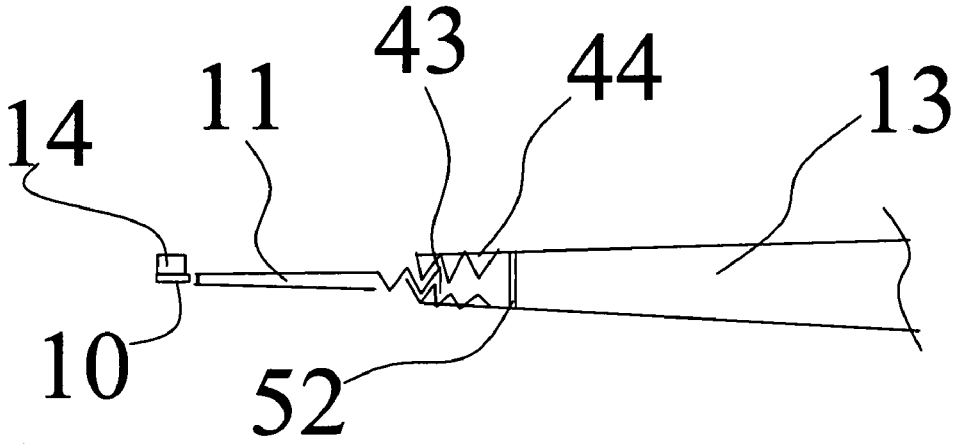
FIG. 8 shows a alternate method of varying the length of the club.

Threads can be seen used in this manner in FIG. 8 where a first tapering section 11 with threads 43 out the outside surface screws into the second tapering end 13 which has cooperating threads 44 inside the end 13. Typically, there would have to be great amount of friction in this threading or a seat 52 or other locking means at the end of the threads 44 to make a secure fit.

It is to be noted that as the handle lengthens, it flexes more and this allows for users, as it goes from a child club length to a grown up club length, to get used to a gradually increase in the amount of flex in the club.

Figure 2:
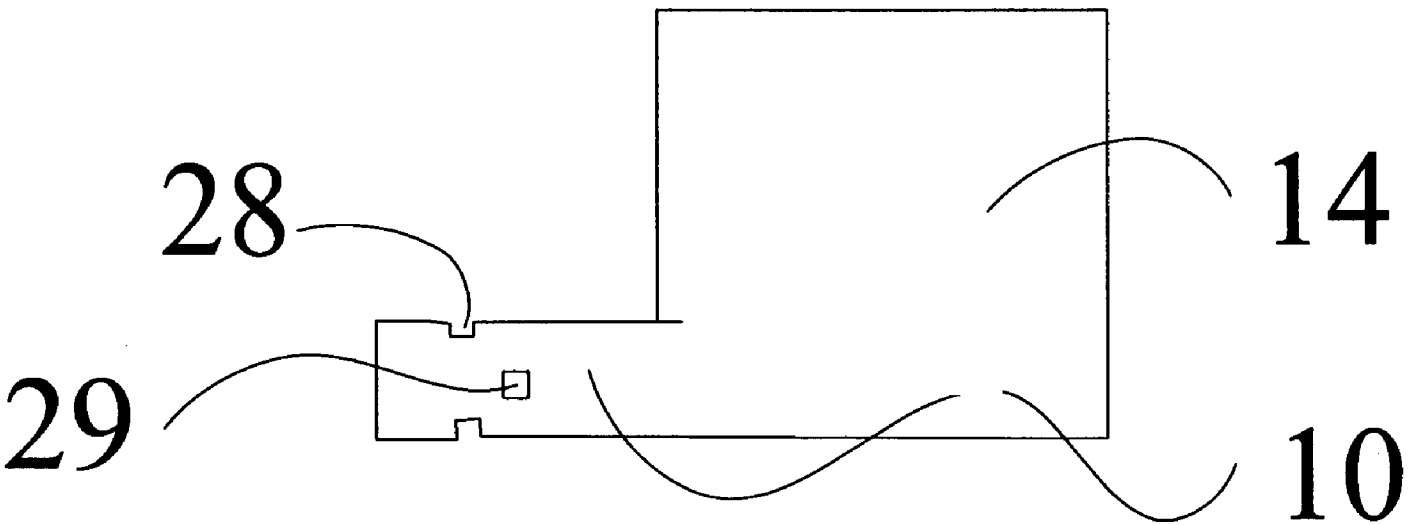
FIG. 2 is an isolated drawing of a club head.

FIG. 2 shows a club head 14 having a striking surface 49, an attachment handle 10 and wherein the attachment handle defines grooves 28 and an alignment extension 29.

Figure 9:
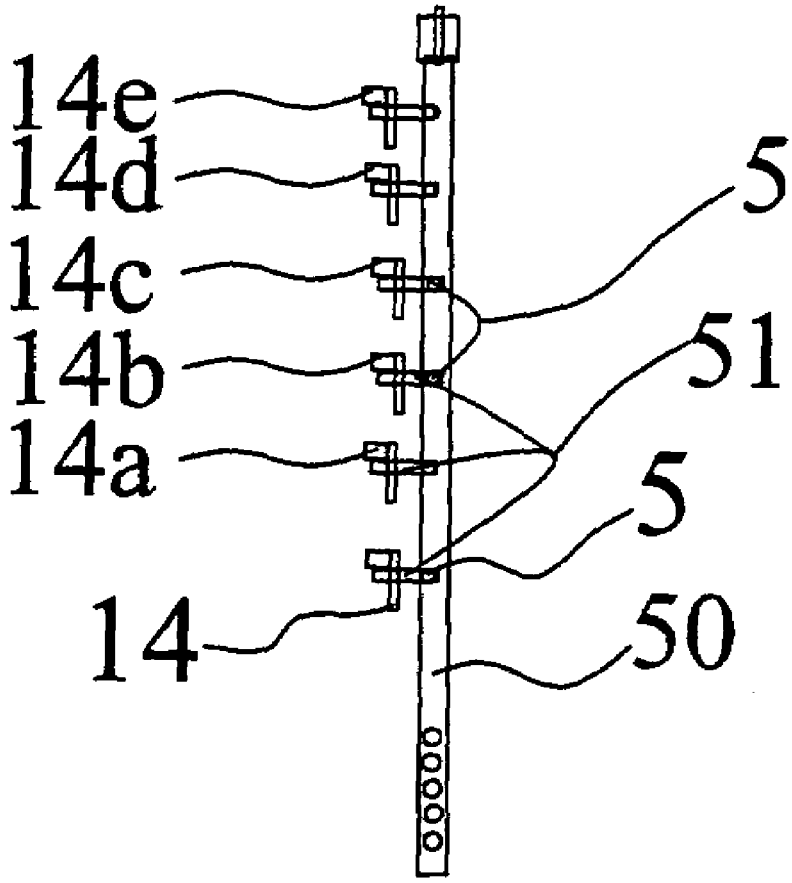
FIG. 9 shows a belt which may be used in lieu of the stands shown in FIGS. 3 & 4.
Figure 10:
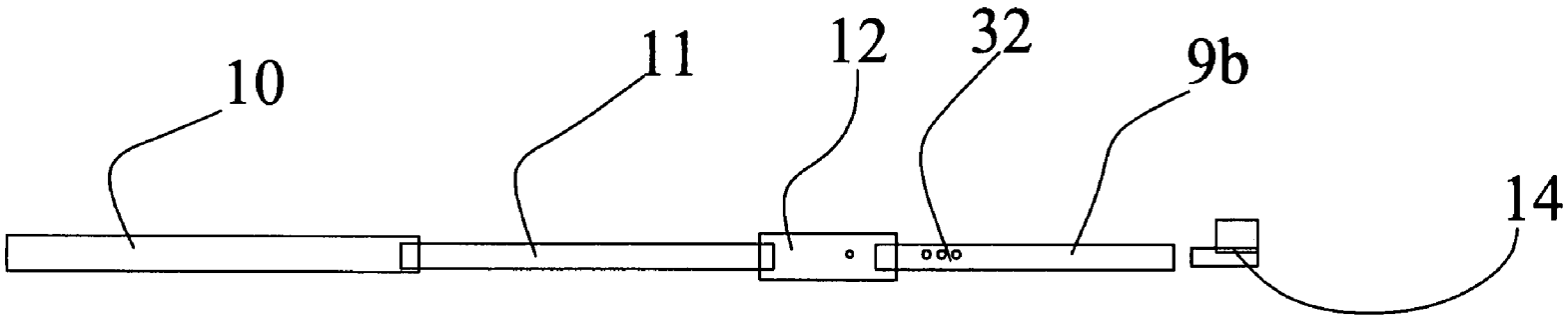
FIG. 10 shows a block diagram of the parts of a club.

The fine adjustment might be preferably at the attachment handle 10, and in FIG. 2, a plurality of club heads 14*a*, 14*b* and 14*c*, 14*d* and 14*e* (as shown in FIG. 9) could be substituted for the head 14 as woods, irons and a putter.

To allow the angle and length of the clubs to be varied, there may be different attachment handles 10 having different lengths and angles of attachment to the club striking surface 49 as described in more detail below in order to keep the striking surfaces 49 properly aligned.

In FIG. 1, the attachment of the attachment handles 10 is accomplished by the same mechanism as the changing length of the club.

In this embodiment, the club heads 14 are interchangeable, utilizing spring released bearings 16*a* within a bearing support cylinder 25*a* which bearings 16*a* can fix the location of the club head 14 on the first tapering end 13 by fitting bearings 16*a* releasably into first holes 17*a* defined by the end of the second tapering end 13. It would be possible to replace these holes 17*a* with threads (also a form of holes) and to replace the bearings 16*a* with threads as shown in FIG. 8. In this case the spring 27*a* has an end attached to the cylinder 25*a* and is fixed on the other end to the second tapering end 13 so that the cylinder 25*a* can move against the spring 27*a* to allow the bearings 16*a* to be locked in place or released into release holes 26*a* defined by the cylinder 25*a*.

To improve alignment, there is an extension 29 off of the attachment handle 10 which fits tightly within slot 19 defined in the bearing support cylinder 25*a*.

At the end 74 of the non tapering section 9 is a bearing support cylinder 25 which defines a space 26, which is typically a groove traveling around the inner circumference of the cylinder 25. Within this cylinder 25 are typically two bearings 16 which fit within grooves defined by the cylinder 25. Typically, the bearing may rotate.

This bearing may be released from pressing on the non tapering section 9, which is the non-tapered portion of second tapering end 13, by pulling the bearing support cylinder 25 against the spring 27 until the bearing 16 can fit within the space 6.

The method of the movement of the bearing holding cylinder, the bearing support cylinder the bearing support cylinder release hole is a mechanism which is known in the prior art of holding mechanisms but is not utilized for the purposes described herein.

In FIG. 1, there are four first hole settings 17 corresponding the lengths for a wood or long irons and there are three second holes 18 which are separated by a substantial space which are the lengths for the short irons.

This way, the at least first set of holes which are at one distance from one another and at least one second set of holes which are at a similar length from one another but separated by an extended length from the first set of holes is provided in order to provide for club lengths to easily be adjusted for wood or easily be adjusted for the irons.

A similar mechanism is provided at the end of the second taper for attaching a club. In this second case there is a specific alignment means which in this case is a slot 19 which receives an extension 29, attached to the club head 14. In this case there is a groove 28*a* which may go all the way around the club head to receive the bearing 16*a* (in this case there is an first bearing and a second bearing on the other side of the club head groove 28 which groove 28 may pass completely around the attachment handle 10 which is also definable as the club head shaft.

The bearing may fit within one of the holes 17 depending on how far the first taper 11 is inserted with section 9 in order to adjust the length of the club to correspond to the necessary length for a particular club head 14.

Figure 4:
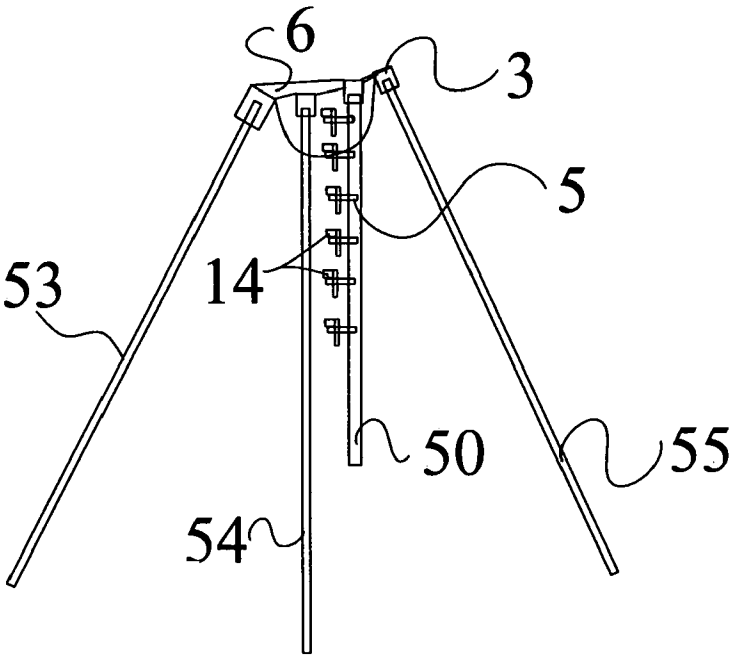
FIG. 4 shows an alternate stand design.
Figure 5A:
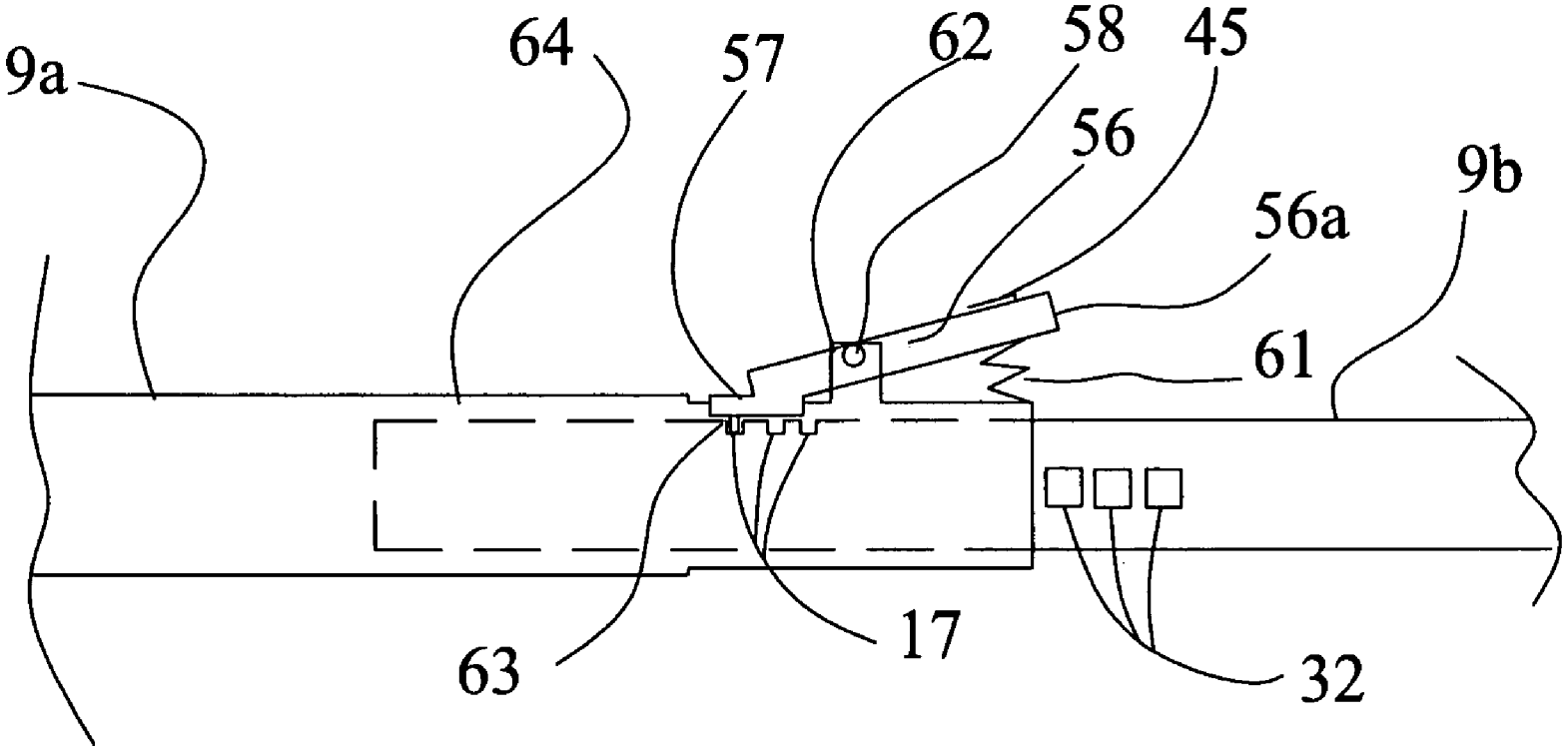
FIG. 5*a* shows a detailed view of the lever arm shown in FIG. 5.

To increase the strength of the unit and to be able to withstand greater force there are, as shown in FIG. 1 and FIG. 7, 1–4 first holes 17 which may align with markings 32 shown in FIG. 5*a* which markings correspond to club heads 14–14*e* so that by matching color, number, etc., the correct alignment may be made for each of the club heads to be attached. Since this may vary for different users, the location of these markings 32 may be changed by the user.

To allow for a single club to be used for vastly different sized club lengths (such as a father and son club), there may be, as shown in FIG. 5, a second grouping of holes 18 into which the locking mechanism may attach.

For a single user, typically the attachment handle could be varied enough so that the club length, at most would only have to be locked in three positions, the three positions being for irons, one for woods, and potentially a different one for a putter.

Figure 7:
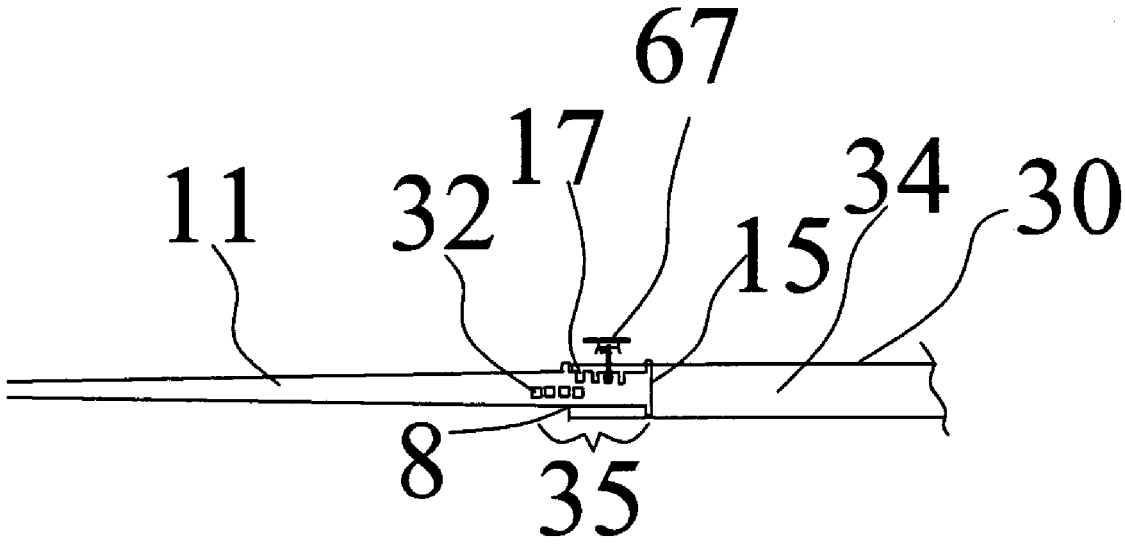
FIG. 7 shows a second alternate design for controlling the length of the club.

As shown in FIG. 7 there may be a safety expansion 15 which can not pass a reduced interior 8 in order to prevent the first taper 11 from slipping completely out of the shaft 34 of the gripping end 30 when the club is adjusted or swung even if the locking means, here a screw 67 into one of several threaded openings 17*c*, were to fail.

Figure 6:
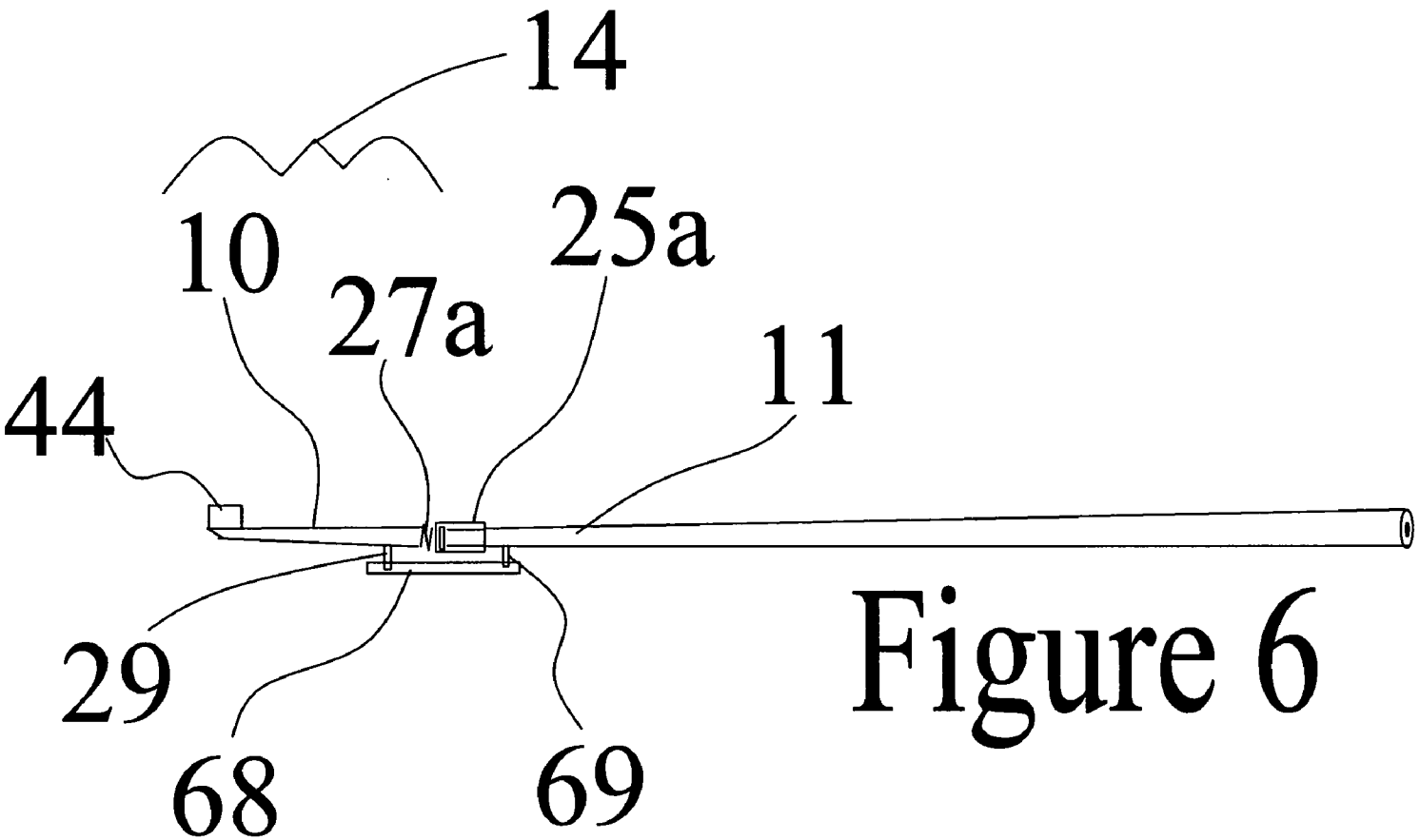
FIG. 6 shows an alternate design of holding a club head.

Another way to accomplish this shown in FIG. 6 uses the extension 29 of the attachment handle 10 locked in position relative to an extension 69 on the first taper 11 with a bar attachable to the extensions 29 and 69.

In the embodiment shown in FIG. 9 the club heads 14–14*e* may be kept in pockets 51 on a belt 50. These pockets may pivot around swivels 5 so that no matter what position the belt 50 is in on the user and whether a shoulder harness or a belt, the clubs heads are held in the pockets 51. These pockets may be clips which tightly hold the club heads 14–14*e*. The belt 50 has a buckle 73 which attaches to the holes 73 in the belt.

Figure 3:
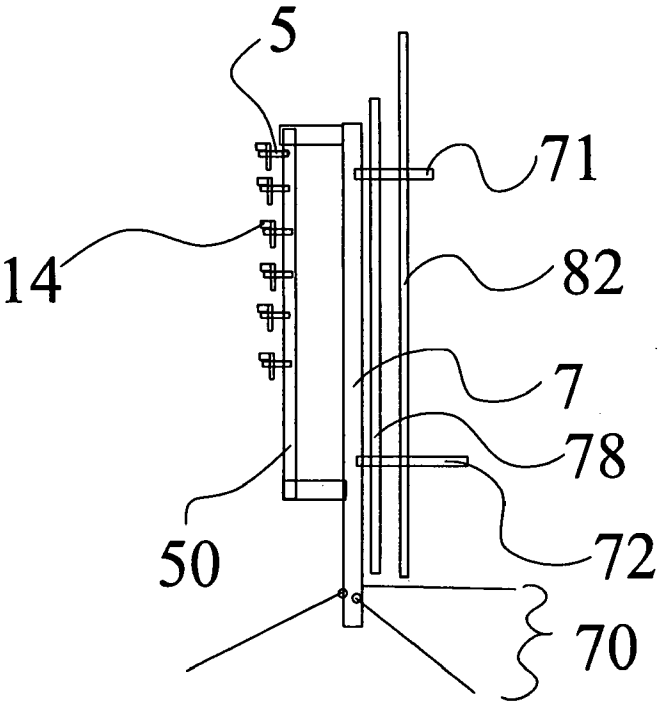
FIG. 3 shows the first embodiment of a stand for use with the invention as otherwise described herein.

FIG. 3 shows that the belt 50 may be supported on a stand 7 which may have clips 71 and 72 which may hold two separate length club handles, being an iron handle 78 and a wood handle 82. This may be supported on a foot 70.

FIG. 4 shows another alternative where three clubs, iron 53, iron 54 and wood 55 which form a tripod. A fourth club (not shown) would be used by the user while the other clubs support the belt 50.

These embodiments, instead of extending clubs, has at least two separate clubs and in this example shown in FIG. 4 there are at least three clubs.

In an alternative embodiment as shown in FIG. 3 there is a stand 7 from which hangs a belt 50 (which could also be a shoulder harness of similar design) having pockets 51 which hold the club heads 14, 14*a*, etc. The foot 70 at the bottom of the single stand allows it to stand upright on its own and this foot may fold inward so as to make it easier to carry.

One embodiment the invention comprises a gripping end 30 which has a taper to the shaft 34 so that the shaft 34 can flex.

If the first taper and attachment handle are long enough, the may also taper so as to be able to flex similarly to an existing club. The tapers may be controlled to make the flex desired.

One improvement is to provide between the gripping end 30 and striking surface 49 an extension means 35 of the type described above comprised of items 25, 16 and 13, by way of example.

Figure 5B:
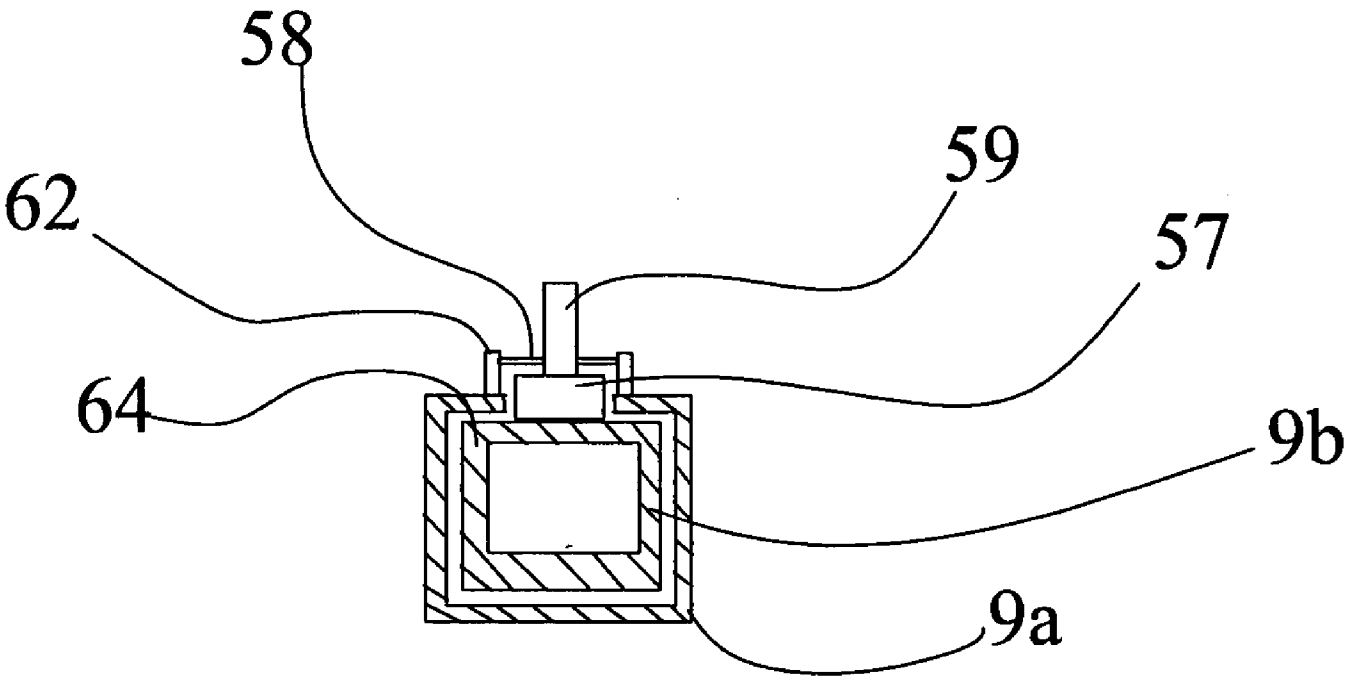
FIG. 5*b* shows a cross section of the lever arm of FIG. 5*a* through the 5*b*—5*b* axis.

While the extension means 35 can have several different varieties, one example shown in FIGS. 5, 5*a* and 5*b* includes a lever arm 56 attached at a pivot arm 62 which is mounted to the gripping end 30. A spring 61 serves to keep the locking arm 63 in the holes 17 which can be found in the second tapering end 13.

The holes 17 may spiral around the outer surface of the tapering end 13. One purpose of having them spiral would be in order to ensure that the correct club head is used. In such an embodiment the club heads would lock in along an axis so that only the correct club would line up correctly depending on how far out or how far turned is one shafts relative to another.

The lever arm 56 rocking arm so that pushing on button 45 (as opposed to a pull button) compresses the rear end 56*a* of the arm 56 rotates the arm 56 around a pivot 58 so as to disengage the locking arm 63 from the hole 17. While referred to as a hold, it may be easily referred to as an indention.

Markings 32 are displayed on the end 13 as it is extended from the inside of the non-tapering section 9*a* so that the user will know which club head, heads 14–14*e* in this example, to use based on the amount of extension. Presumably these markings would be number coded for irons from 2 to 9, and also for pitching(P) and sand wedges(S), and similarly could be marked for woods 1 through 5. Other clubs are available, but those are the club numbers that would be found with a standard club set.

As can be seen by reference to FIGS. 5, 5*a* and 5*b* one or both of the sleeve and ball bearing securing means may be replaced by a frictional lever means.

In this case the fictional lever means is comprised of what can best be seen by reference to FIG. 5*a*, the first non tapering section 9*a*, a continuation of gripping end 30, receives the second non-tapering section 9*b*, a continuation of second tapering end 13 in the manner consistent with that described in reference to FIG. 1.

Here it is a fictional brake 57, which is mounted onto one end of a lever arm 56 with the far end 59 of the lever arm being held by expanding spring 61 in frictional contact with the top surface 64 of the second non tapering section 9*b*. This may or may not be assisted by way of a locking arm 63 fitting into a hole 17 in the second non-tapering section 9*b*.

The brake 57 pivots in response to pressure on the button 45 on top of the lever arm 56 by the user pushing down on the button 45 to release the brake and adjust the club.

As can be seen by reference to FIG. 5*b*, the non tapering sections 9*a* and 9*b* may be square so as to improve their alignment relative to one another.

The graduated markings 32 function to allow the user to know which hole 17 is being used depending on which one is displayed in a method discussed in more detail below.

Figure 18:
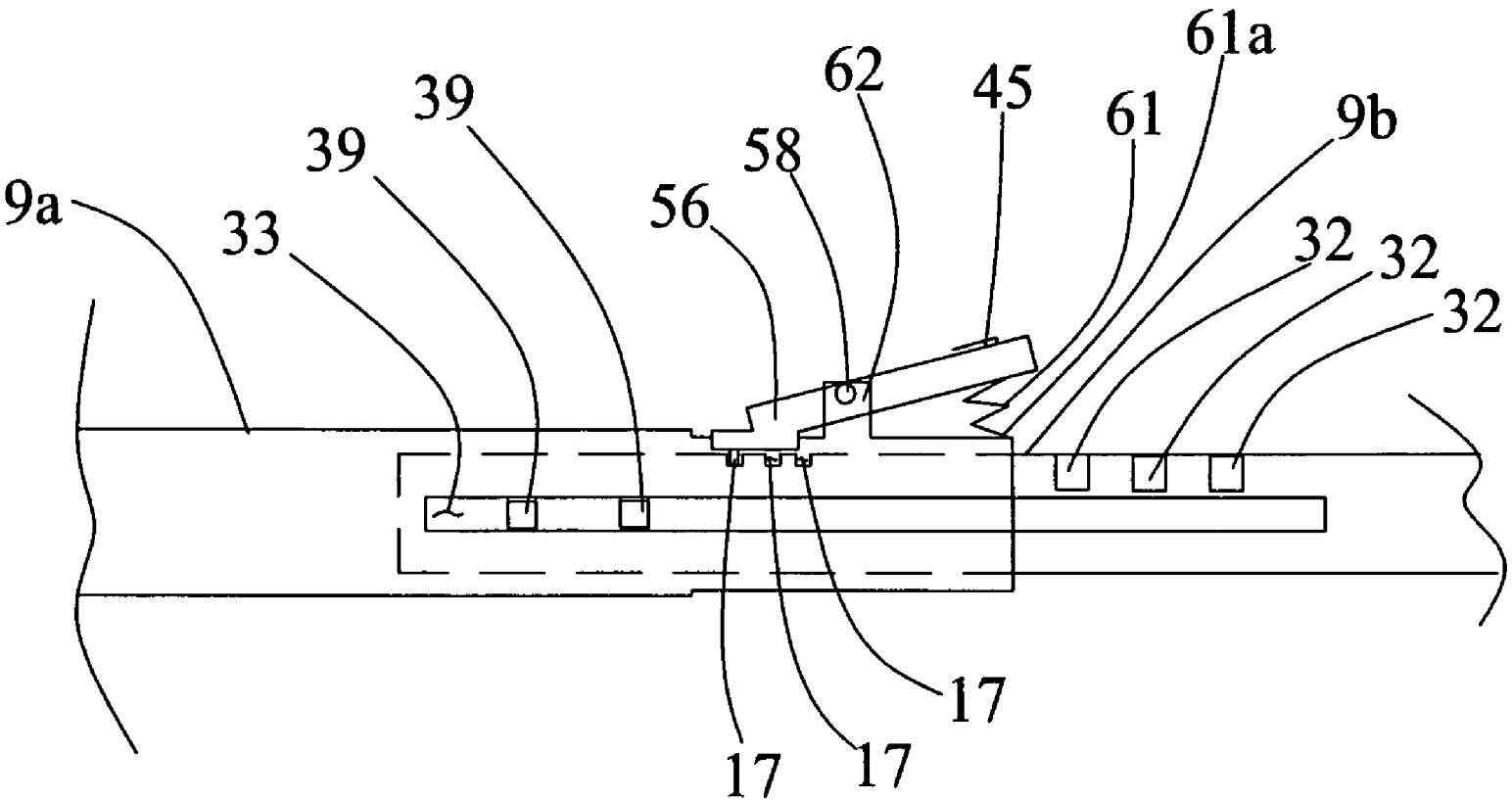
FIG. 18 shows a side view of an alternate embodiment of the invention.

FIG. 18 shows where the pivoting mechanism described above has been moved inside of section 9*a*. Here alignment is maintained by a groove 33 in the section 9*b* and one or more bearings, pegs 39, fitting tightly within the top and bottom walls of the groove 33. The pivot arm 62 extends into the interior of section 9*a* and the pivot 58 is inside the interior. Only the button 45 extends out of an opening provided for this purpose in section 9*a*. The spring 61 is shown on a mounting plate 61*a* attached to the interior of section 9*a*, but it could also run from the arm 56 to the top of section 9*a*. While a gap in the interior of the interior walls of section 9*a* would be necessary, the remainder of section 9*a*'s interior walls would be approximately equal to the exterior size of section 9*b* to ensure a tight, non moving fit. To ensure this, dampers may be used as described in more detail in reference to FIG. 15.

While a single extension of this type is adequate in order to allow for the club to function, there are reasons related to design where two separate adjusting ends might be desirable. The primary reason for this is because there is one gross adjustment which is important for going from the length of an iron to the length of a wood, and then there are more fine adjustments for the different size irons and the different size woods in a standard golf set. Also, more than one extension means of the type shown may be present.

In another embodiment, instead of, or in addition to, having the length of the club change, the attachment handle 10 on each club head 14 is a different length.

In this way, depending on which club head is selected, the length of that club head is automatically changed.

This allows the entire club to taper all the way down to the point in which the club head is attached to allow for greater flexibility in the shaft.

Figure 11:
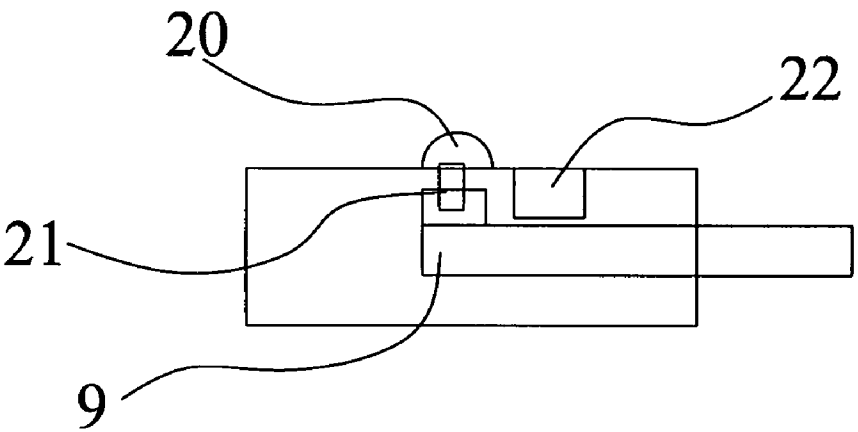
FIG. 11 shows an alternate locking mechanism for holding club heads.
Figure 13:
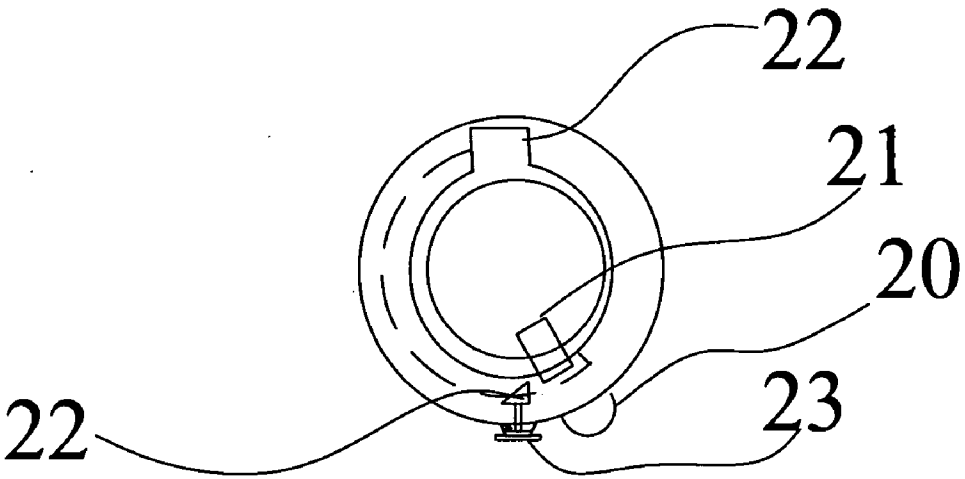
FIG. 13 shows a transparent top view through the 13—13 access of FIG. 11.
Figure 12:
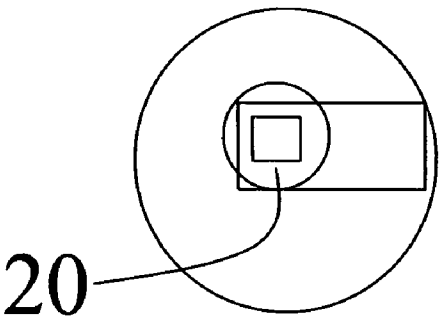
FIG. 12 shows a cross sectional view through the 12—12 access of FIG. 11.

FIGS. 10–13 show a pop-in and pop-out and twisting attachment on the club heads in order to make sure that they are locked in place when they are inserted on the head. As shown in FIGS. 11–13, there may be an alignment window 20 which may be aligned with color coded alignment indicator 21 which shows that the club is properly aligned so that the user will know that the club head will not slip out because of the proper alignment.

There may also be a secondary pen 22 holding the club by way of a club locking bracket 23 so that when a club is twisted in place and aligned it can not be unaligned without the user consciencely moving the secondary pen 22 which may be put in place over the insertion location by which twisting allows for the alignment window to be inspected.

As can best be seen in FIG. 1, the invention comprises a gripping end 30 which has a first taper 11 to a non tapering section 9. The reason that section 9 does not taper is in order to allow for the securing means to secure the position of the gripping end with the first taper 11 to the second tapering end 13. In this embodiment, in order to secure the second end to the first end, the gripping end 30 is hollow so as to receive a portion of the second tapering end 13 at the non tapering section 9 of each end.

Figure 14:
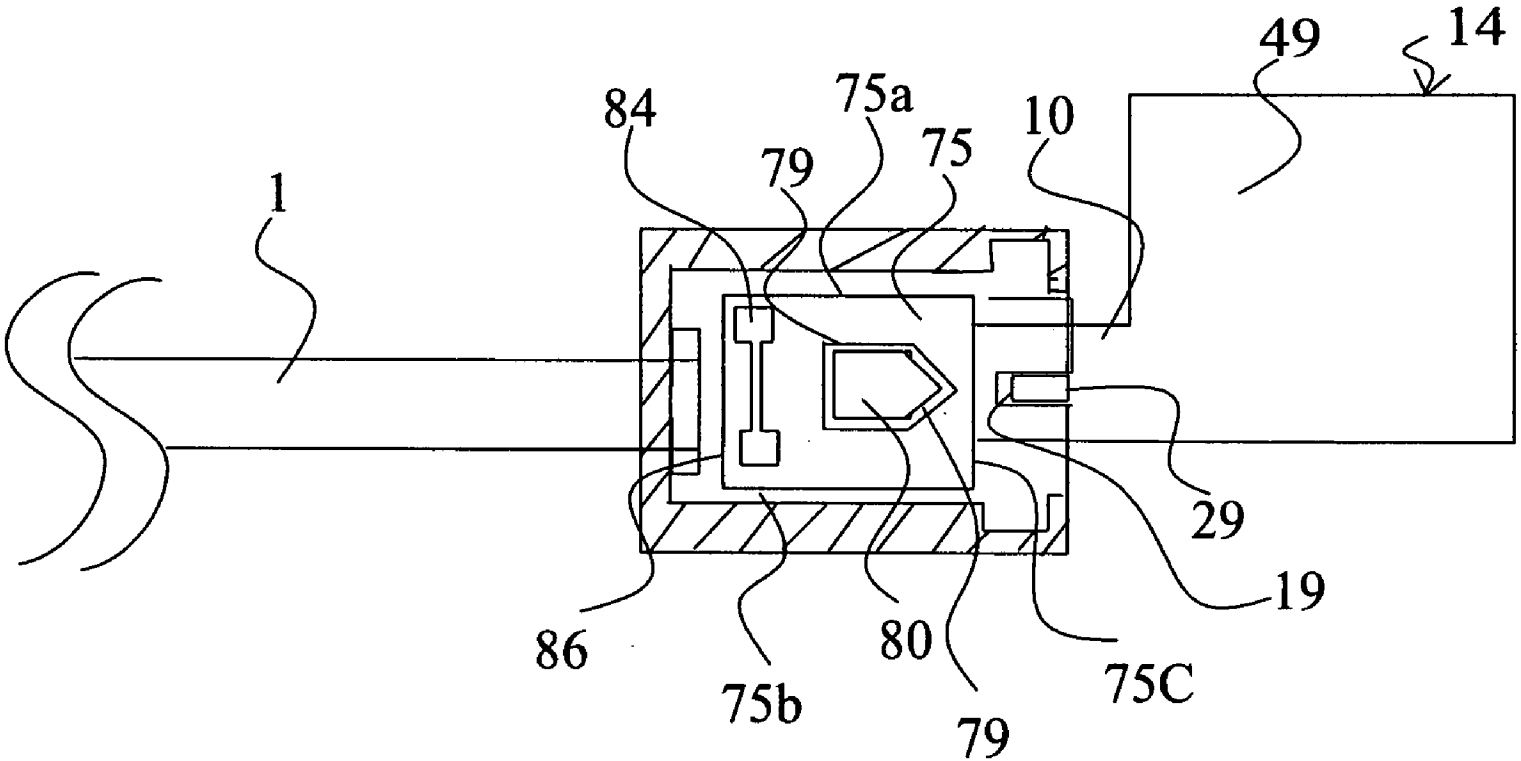
FIG. 14 shows a side view of a club incorporating an alternative connecting means.
Figure 15:
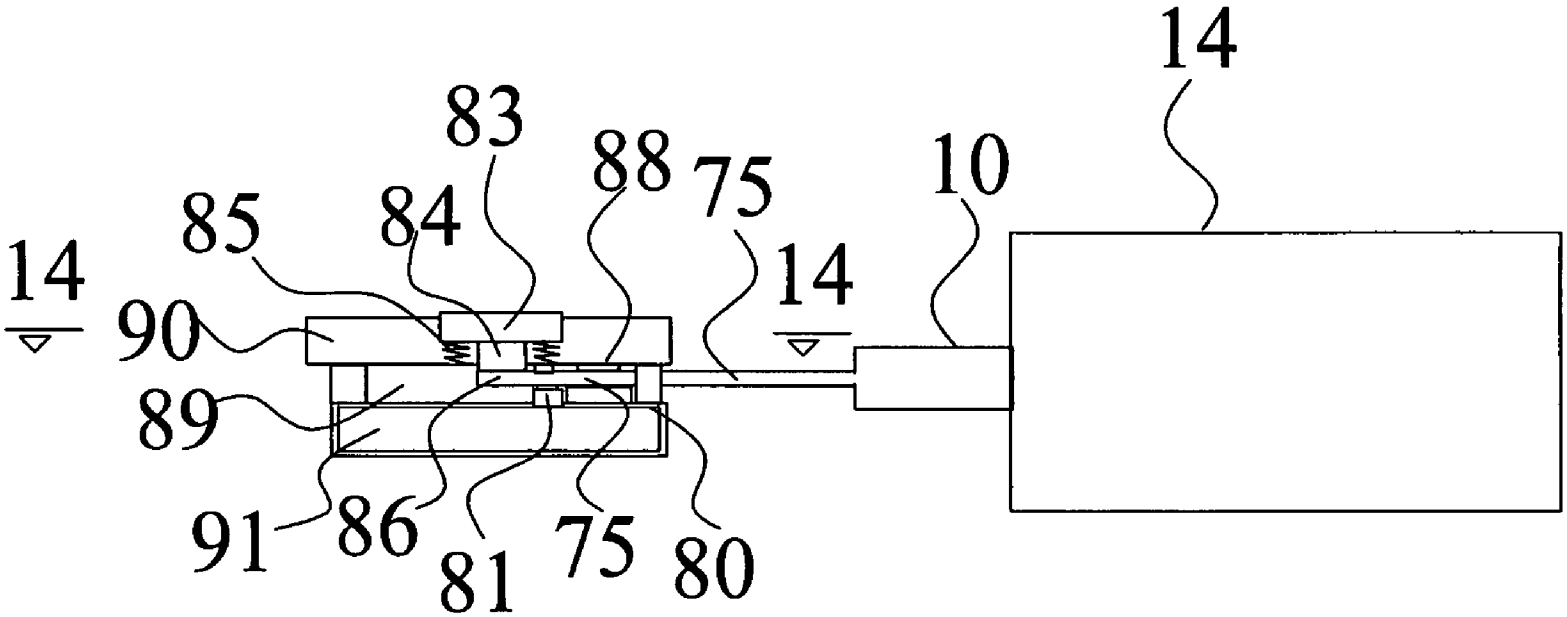
FIG. 15 shows a 90 degree rotation of the view in FIG. 14.
Figure 17:
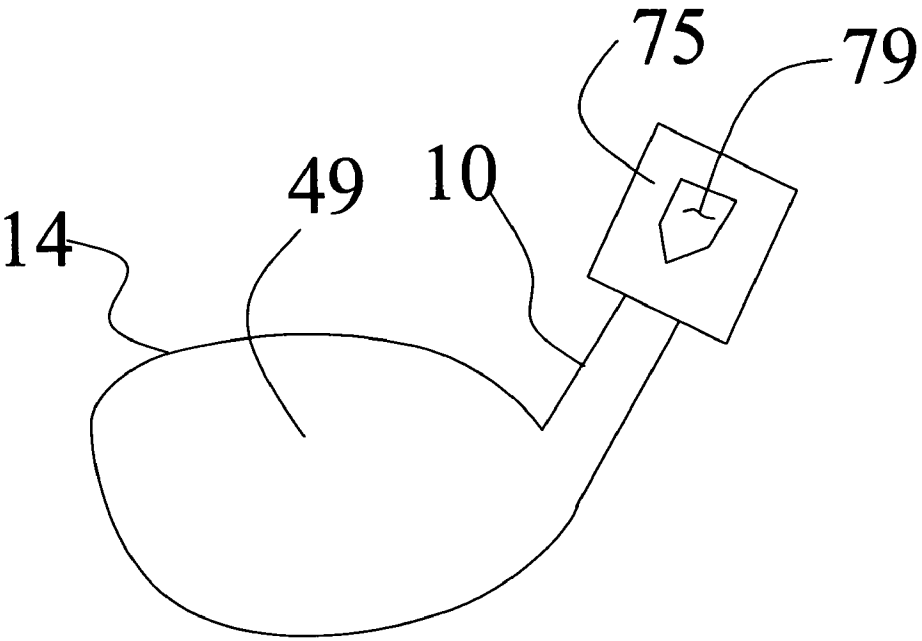
FIG. 17 shows a side view of the club head from FIG. 16.
Figure 16:
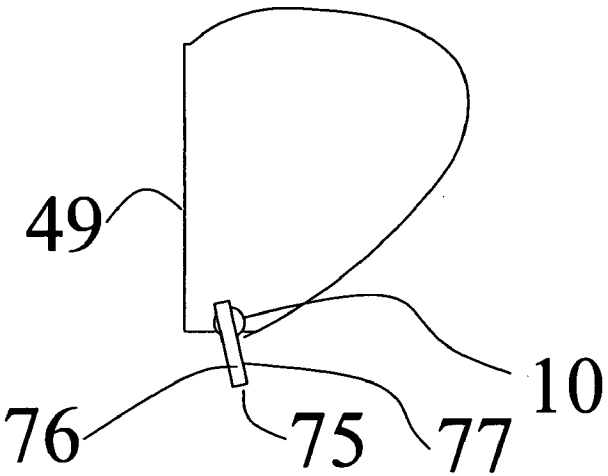
FIG. 16 shows a top view of the club head.

FIG. 14 shows a side view of a club incorporating an alternative connecting means for club heads 14. FIG. 15 shows a 90 degree rotation of the view in FIG. 14. FIG. 16 shows a top view of the club head used in FIG. 14 and FIG. 17 shows a side view of the club head from FIG. 16.

As set forth above, the combined device is for playing golf requiring at least two clubs with a first length and a second length comprising. In this case, the first length and second length are taken care of by having a club which changes size or by having heads with different length shafts attached.

In this embodiment, there are multiple club heads comprising at least one first club head comprising:

i) a striking face 49 having a face contact angle which is known in the prior art as the loft or the angle of the clubface that controls trajectory and affects distance;

ii) an extension, here the attachment handle 10 having a length with a first end and a second end connected to the striking face 49 at a connection angle and wherein the attachment handle second end comprises a flat surface 75 defining at least one top face 76 and at least one bottom face 77; and b) a club 1 having a gripping end 30 (FIG. 1) and a club head end as shown in FIG. 14, said club head end further comprising a grasping means for releasably holding the face in a rotationally fixed position wherein the striking surface is held at the appropriate angle for striking the ball when connected as shown in FIG. 14.

The flat surface has a length and a width and a thickness and the length is at least one half inch wide. The width is at least one half inch wide. However, the length is preferably at least one inch wide and the width is at least one inch wide to provide sufficient bracing as described below.

The thickness of this flat section is less than ½ inch.

The flat surface 75 as shown in FIG. 16 defines a top face 76 and a bottom face 77 and a first side 75*a* and a second side 75*b* and a first end 86 and a back 75*c* and the flat surface 75 defines an opening 79 through the top face 76 and a bottom face 77 between the first side 75*a* second side 75*b*, first end 86, and back 75*c*.

The grasping means further comprises an extension 80 releasably insertable into the flat surface opening 79. The grasping means further comprises a top wall 90 and a bottom wall 91 separated by a slot 89 wherein slot defines a slot height which height is approximately equal to the thickness of the flat surface 75 so that the flat surface is tightly held rotationally and otherwise. The opening 79 being in the center of the flat surface and the extension being the same size and shape as the opening 79 also helps to tightly hold the flat surface and therefore the club.

The top wall and bottom wall contact at least a portion of the top face and bottom face of the flat surface, as indicated above, at least ½ square inch of each surface.

The flat surface 75 has a first end 86 insertable into the opening between the top wall 90 and bottom 91 wall and aback 75*c* which is attached to handle 10 and a middle between the first end 86 and the back 75*c*. The middle is pivoted about a fulcrum 81 which fulcrum is attached to the bottom wall 91. The top wall 90 defines an opening. This top wall opening shown in FIG. 15 allows the user to press the button 83 within the opening which pushes against springs 85 to press pressing surface 84 against the first end 86 of the flat surface 75 to pivot the opening 79 out of contact with the extension 80 sufficiently so that the flat surface 75 may be removed to change clubheads 14.

In the preferred embodiment, this invention comprises at least one second one club head comprising:

i) a striking surface having a face contact angle different from the face contact angle of the at least one first club head; and ii) an extension having a length with a first end and a second end connected to the striking surface at an connection angle said extension second end comprising a flat surface defining at least one face.

Typically, the first club head connection angle is different from the second club head connection angle.

As shown in FIG. 14, the opening has a shape and the insertion has a corresponding shape of the same size and shape, here pointed to more easily allow insertion.

The shape is designed to allow for easy insertion and prevent release.

Figure 19:
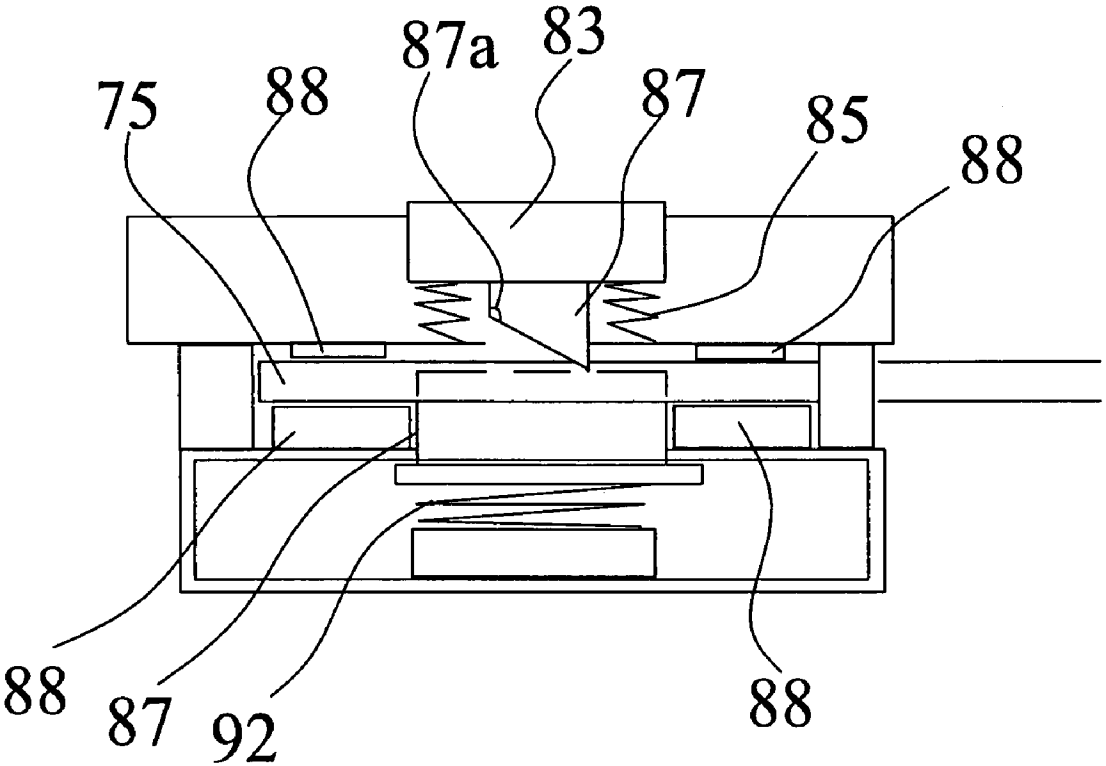
FIG. 19 shows a view through the 19—19 axis of FIG. 18.

FIG. 19 shows a close up of an alternate flat surface holding means wherein there is a shaped extension 87 extending from the button 83 which can push extension 80 out from the opening 79 against a spring 92. Semi-rigid cushioning 88 serves to more securely hold and cushion the flat surface against swings and impacts as the club is used. The angle 87*a* allows the club head flat surface 75 to slide out after the extension 87 is disengaged.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. A device for playing golf requiring at least two clubs with a first length and a second length comprising:

a) at least one first club head comprising:

i) a striking surface having a face contact angle;

b) an extension having a length with a first end and a second end connected to the club head;

ii) said extension second end comprising a flat section having a top face and a bottom face; and c) a club having a gripping end and a club head end said club head end further comprising a buckle grasping means defining a slot said buckle grasping means comprising above the slot a top and below the slot a bottom for releasably receiving and holding the flat section so that the top face is against the top of the slot and the bottom face is against the bottom of the slot and wherein the flat section defines a first opening and wherein the buckle grasping means further comprises a fulcrum means for pivoting the flat section attached to the bottom and an insertion means for removable insertion into the first opening to prevent the flat section from escaping the slot when the insertion means is inserted and wherein the flat section has a length and a width and a thickness and wherein the length is at least a half inch wide and the width is at least a half inch wide and wherein the flat section has a first end insertable into the slot and a second end extending out of the slot and a middle between the first end and the second end and wherein the middle is pivoted about the fulcrum means and wherein the top defines a top opening over the first end so that the first end is able to be depressed through the top opening pivoting the insertion means out of the first opening.

2. The invention of claim 1 wherein the top further comprises at least one semi-rigid cushion means over the second end said cushion means for compressing upon pressure on the first end pivoting the second end into the cushion means.

3. The device of claim 1 wherein the top further comprises a button which button is flexibly secured through the top opening and secured to the top by a spring means for biasing the button away from contact with the first end.

4. The device of claim 1 further comprising at least one second club head comprising:

i) a second club striking surface having a face contact angle different from the face contact angle of the at least one first club head.

5. The device of claim 1 wherein the first opening has a shape and a size and wherein the insertion means comprises a plug having a plug shape and a plug size and said plug shape and plug size are approximately equal to the size and shape of the first opening.

6. The device of claim 5 wherein the flat section middle has a length and a width and wherein the length is at least one inch and the width is at least one inch.

7. The device of claim 6 wherein the middle has a thickness and thickness is less than ½ inch.

8. The device of claim 1 wherein the first opening defines a shape and wherein the insertion means comprises a plug having a plug shape equal to the same shape as of the first opening releasably insertable into the first opening.

9. The device of claim 1 wherein the flat section middle defines a flat section left and a flat section right and wherein the grasping means further comprises a left side wall on the left side of the slot and a right side wall on the right side of the slot and wherein the slot has a width between the left side wall and right side wall and the middle has a middle width approximately equal to the slot width.

10. The device of claim 9 wherein the top contacts the top face and bottom contacts the bottom face of the flat section when the flat section is inserted within the slot.

11. The device of claim 10 wherein the top contacts at least one square half inch of the top face of the flat section and the bottom contacts at least one square half inch of the bottom face.

12. The device of claim 10 wherein the middle is pivoted about the fulcrum means when the flat section is inserted in the slot and wherein the top defines a top opening over the first end so that the first end is able to be depressed though the top opening pivoting the insertion means out of the first opening.

13. The device of claim 1 wherein the top grasping means further comprises a button means fitting within the top opening for pivoting the insertion means out of the first opening in response to force exerted on the button means.

* * * * *